US010273436B2

(12) United States Patent
Asmanidou et al.

(10) Patent No.: US 10,273,436 B2
(45) Date of Patent: Apr. 30, 2019

(54) HARD SURFACE CLEANERS COMPRISING A COPOLYMER

(71) Applicant: The Procter & Gamble Company, Cincinnati, OH (US)

(72) Inventors: Anna Asmanidou, Brussels (BE); Aaron Flores-Figueroa, Mannheim (DE); Frank Hulskotter, Schwalbach am Taunus (DE); Martin Ruebenacker, Altrip (DE); Stefano Scialla, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/481,487

(22) Filed: Apr. 7, 2017

(65) Prior Publication Data

US 2017/0292091 A1 Oct. 12, 2017

(30) Foreign Application Priority Data

Apr. 8, 2016 (EP) ..... 16164578
Jan. 2, 2017 (EP) ..... 17150063

(51) Int. Cl.

| | |
|---|---|
| ***C11D 3/37*** | (2006.01) |
| ***C11D 1/62*** | (2006.01) |
| ***C11D 1/66*** | (2006.01) |
| ***C11D 1/75*** | (2006.01) |
| ***C11D 3/30*** | (2006.01) |
| ***C11D 11/00*** | (2006.01) |
| ***C11D 1/83*** | (2006.01) |
| *C11D 1/72* | (2006.01) |

(52) U.S. Cl.
CPC ..... *C11D 3/3776* (2013.01); *C11D 1/62* (2013.01); *C11D 1/66* (2013.01); *C11D 1/75* (2013.01); *C11D 1/83* (2013.01); *C11D 3/30* (2013.01); *C11D 3/3769* (2013.01); *C11D 11/0023* (2013.01); *C11D 1/72* (2013.01)

(58) Field of Classification Search
CPC ..... C11D 11/0023; C11D 3/3769; C11D 1/72
USPC ..... 510/475
See application file for complete search history.

(56) References Cited

U.S. PATENT DOCUMENTS

| | | | | |
|---|---|---|---|---|
| 6,964,774 | B1 * | 11/2005 | Dieing | A61K 8/894 424/401 |
| 7,160,947 | B2 | 1/2007 | Claesson et al. | |
| 2005/0113280 | A1 * | 5/2005 | Reddy | C11D 3/0036 510/475 |
| 2017/0096623 | A1 * | 4/2017 | Tollens | C11D 11/0023 |
| 2017/0096626 | A1 * | 4/2017 | Tollens | C11D 17/049 |
| 2017/0292093 | A1 * | 10/2017 | Ward | A47L 15/0007 |

FOREIGN PATENT DOCUMENTS

WO WO 2014/081699 A1 5/2014

OTHER PUBLICATIONS

Extended European Search Report; Application No. 16164578.3-1375; dated Oct. 26, 2016; 7 pages.
Database WPI; Week 200406; Thomson Scientific, London, GB; XP002762452 & JP 2003 183694 A (Lion Corp); Jul. 3, 2003; abstract and translation.

* cited by examiner

*Primary Examiner* — Gregory E Webb
(74) *Attorney, Agent, or Firm* — John T. Dipre

(57) ABSTRACT

The need for a liquid hard surface cleaning composition which provides reduced drying time is met by formulating the composition using copolymer comprising non-ionic monomeric units, a low level of cationic monomeric units, and other optional monomers.

11 Claims, No Drawings

HARD SURFACE CLEANERS COMPRISING A COPOLYMER

FIELD OF THE INVENTION

Hard surface cleaning compositions comprising a copolymer and their use in reducing drying time for treated hard surfaces.

BACKGROUND OF THE INVENTION

Hard surface cleaning compositions are used for cleaning and treating hard surfaces. Preferably, the hard surface cleaning composition is formulated to be an "all purpose" hard surface cleaning composition. That is, the hard surface cleaning composition is formulated to be suitable for cleaning as many different kinds of surfaces as possible. Hard surface cleaning compositions are typically diluted before use in a bucket before being applied to the surface being cleaned using a mop, sponge, cloth or similar device. Especially when cleaning particularly dirty floors, film and streak residues may be left which result in poor shine, and an impression that the surface is not yet sufficiently clean. In addition, such floors, washed with diluted hard surface cleaning compositions, tend to be slippery with a resultant increase in the risk of falls and similar accidents, until dry. Hence, a need remains for a composition which provides reduced drying time for treated surfaces, in addition to improved cleaning and shine.

WO2005/052107 relates to laundry compositions having copolymers containing polyalkylene oxide groups and quanternary nitrogen atoms and a surfactant system. WO 2005/052107 relates to a detergent composition having a copolymer containing polyalkylene oxide groups and quaternary nitrogen atoms and a surfactant system for clay soil removal and anti-redeposition benefits on surfaces such as fabrics and hard surfaces.

SUMMARY OF THE INVENTION

The present invention relates to a hard surface cleaning composition, as described in claim 1, which comprises a copolymer. The present invention further relates to a method of reducing the drying time of treated hard surfaces, the method comprising the following steps: diluting a liquid hard surface cleaning composition of any preceding claim; and applying the diluted composition to a hard surface. The present invention further relates to the use of the copolymer for reducing the drying time of treated hard surfaces.

DETAILED DESCRIPTION OF THE INVENTION

Hard surface cleaning compositions of the present invention, comprising a copolymer reduces the drying time of treated surfaces, as well as improves shine and cleaning in combination with detergent surfactants.

As defined herein, "essentially free of" a component means that no amount of that component is deliberately incorporated into the respective premix, or composition. Preferably, "essentially free of" a component means that no amount of that component is present in the respective premix, or composition.

As used herein, "isotropic" means a clear mixture, having little or no visible haziness, phase separation and/or dispersed particles, and having a uniform transparent appearance.

As defined herein, "stable" means that no visible phase separation is observed for a premix kept at 25° C. for a period of at least two weeks, or at least four weeks, or greater than a month or greater than four months, as measured using the Floc Formation Test, described in USPA 2008/0263780 A1.

All percentages, ratios and proportions used herein are by weight percent of the premix, unless otherwise specified. All average values are calculated "by weight" of the premix, unless otherwise expressly indicated.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

Liquid Hard Surface Cleaning Compositions:

By "liquid hard surface cleaning composition", it is meant herein a liquid composition for cleaning hard surfaces found in households, especially domestic households. Surfaces to be cleaned include kitchens and bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, steel, kitchen work surfaces, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

In a preferred embodiment, the liquid compositions herein are aqueous compositions. Therefore, they may comprise from 30% to 99.5% by weight of the total composition of water, preferably from 50% to 98% and more preferably from 80% to 97%.

The compositions of the present invention preferably have a viscosity from 1 cps to 650 cps, more preferably of from 100 cps to 550 cps, more preferably from 150 cps to 450 cps, even more preferably from 150 cps to 300 cps and most preferably from 150 cps to 250 cps when measured at 20° C. with a AD1000 Advanced Rheometer from Atlas® shear rate 10 $s^{-1}$ with a coned spindle of 40 mm with a cone angle 2° and a truncation of ±60 μm.

The pH is preferably from 7.0 to 12, more preferably from 7.5 to 11.5, even more preferably from 9.5 to 11.3, most preferably 10 to 11. It is believed that the greasy soil and particulate greasy soil cleaning performance is further improved at these preferred alkaline pH ranges. Accordingly, the compositions herein may further comprise an acid or base to adjust pH as appropriate. The pH of the cleaning compositions is measured at 25° C.

A suitable acid for use herein is an organic and/or an inorganic acid. A preferred organic acid for use herein has a pKa of less than 6. A suitable organic acid is selected from the group consisting of: citric acid, lactic acid, glycolic acid, succinic acid, glutaric acid and adipic acid and mixtures thereof. A suitable inorganic acid can be selected from the group consisting of: hydrochloric acid, sulphuric acid, phosphoric acid and mixtures thereof.

A typical level of such acids, when present, is from 0.01% to 5.0% by weight of the total composition, preferably from 0.04% to 3.0% and more preferably from 0.05% to 1.5%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (such as monoethanolamine, triethanolamine, aminomethylpropanol, and mixtures thereof).

Typical levels of such bases, when present, are from 0.01% to 5.0% by weight of the total composition, preferably from 0.05% to 3.0% and more preferably from 0.1% to 2.0%.

The total amount of surfactant, excluding the copolymer, is preferably from 2 to 20, more preferably from 3 to 15 and most preferably from 5 to 12% by weight of the composition.

The weight ratio of anionic surfactant to non-ionic surfactant is preferably from 0.06 to 1.00, more preferably from 0.08 to 0.80, more preferably from 0.10 to 0.60, and most preferably from 0.12 to 0.50.

All ratios are calculated as a weight/weight level, unless otherwise specified.

The Copolymer:

The hard surface cleaning composition of the invention preferably comprises from 0.01% to 10%, more preferably from 0.05% to 8%, especially from 0.1% to 7%, by weight of the cleaning composition, of the copolymer.

The copolymer comprises monomers selected from the group comprising monomers of formula (I) (Monomer A) and monomers of formula (IIa-IId) (Monomer B). The copolymer comprises from 60 to 99%, preferably from 70 to 95% and especially from 80 to 90% by weight of at least one monoethylenically unsaturated polyalkylene oxide monomer of the formula (I) (monomer A)

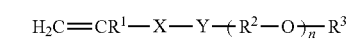

$$H_2C{=}CR^1{-}X{-}Y{-}(R^2{-}O)_n{-}R^3 \quad \text{I}$$

wherein Y of formula (I) is selected from —O— and —NH—; if Y of formula (I) is —O—, X of formula (I) is selected from —$CH_2$— or —CO—, if Y of formula (I) is —NH—, X of formula (I) is —CO—; $R^1$ of formula (I) is selected from hydrogen, methyl, and mixtures thereof; $R^2$ of formula (I) is independently selected from linear or branched $C_2$-$C_6$-alkylene radicals, which may be arranged blockwise or randomly; $R^3$ of formula (I) is selected from hydrogen, $C_1$-$C_4$-alkyl, and mixtures thereof; n of formula (I) is an integer from 5 to 100, preferably from 10 to 70 and more preferably from 20 to 50.

The copolymer comprises from 1 to 40%, preferably from 2 to 30% and especially from 5 to 20% by weight of at least one quaternized nitrogen-containing monoethylenically unsaturated monomer of formula (IIa-IIc) (monomer B).

The monomers are selected such that the copolymer has a weight average molecular weight ($M_w$) of from 20,000 to 500,000 g/mol, preferably from greater than 25,000 to 150,000 g/mol and especially from 30,000 to 80,000 g/mol.

The copolymer preferably has a net positive charge at a pH of 5 or above.

The copolymer for use in the present invention may further comprise monomers C and/or D. Monomer C may comprise from 0% to 15%, preferably from 0 to 10% and especially from 1 to 7% by weight of the copolymer of an anionic monoethylenically unsaturated monomer.

Monomer D may comprise from 0% to 40%, preferably from 1 to 30% and especially from 5 to 20% by weight of the copolymer of other non-ionic monoethylenically unsaturated monomers.

Preferred copolymers according to the invention comprise, as copolymerized Monomer A, monoethylenically unsaturated polyalkylene oxide monomers of formula (I) in which Y of formula (I) is —O—; X of formula (I) is —CO—; $R^1$ of formula (I) is hydrogen or methyl; $R^2$ of formula (I) is independently selected from linear or branched $C_2$-$C_4$-alkylene radicals arranged blockwise or randomly, preferably ethylene, 1,2- or 1,3-propylene or mixtures thereof, particularly preferably ethylene; $R^3$ of formula (I) is methyl; and n is an integer from 20 to 50.

Monomer A

A monomer A for use in the copolymer of the present invention may be, for example:

(a) reaction products of (meth)acrylic acid with polyalkylene glycols which are not terminally capped, terminally capped at one end by alkyl radicals; and (b) alkenyl ethers of polyalkylene glycols which are not terminally capped or terminally capped at one end by alkyl radicals.

Preferred monomer A is the (meth)acrylates and the allyl ethers, where the acrylates and primarily the methacrylates are particularly preferred. Particularly suitable examples of the monomer A are:

(a) methylpolyethylene glycol (meth)acrylate and (meth) acrylamide, methylpolypropylene glycol (meth)acrylate and (meth)acrylamide, methylpolybutylene glycol (meth)acrylate and (meth)acrylamide, methylpoly(propylene oxide-co-ethylene oxide) (meth)acrylate and (meth)acrylamide, ethylpolyethylene glycol (meth) acrylate and (meth)acrylamide, ethylpolypropylene glycol (meth)acrylate and (meth)acrylamide, ethylpolybutylene glycol (meth)acrylate and (meth)acrylamide and ethylpoly(propylene oxide-co-ethylene oxide) (meth)acrylate and (meth)acrylamide, each with 5 to 100, preferably 10 to 70 and particularly preferably 20 to 50, alkylene oxide units, where methylpolyethylene glycol acrylate is preferred and methylpolyethylene glycol methacrylate is particularly preferred;

(b) ethylene glycol allyl ethers and methylethylene glycol allyl ethers, propylene glycol allyl ethers and methylpropylene glycol allyl ethers each with 5 to 100, preferably 10 to 70 and particularly preferably 20 to 50, alkylene oxide units.

The proportion of Monomer A in the copolymer according to the invention is 60% to 99% by weight, preferably 70% to 95%, more preferably from 80% to 90% by weight of the copolymer.

Monomer B

A monomer B that is particularly suitable for the copolymer of the invention includes the quaternization products of 1-vinylimidazoles, of vinylpyridines, of (meth)acrylic esters with amino alcohols, in particular N,N-di-$C_1$-$C_4$-alkylamino-$C_2$-$C_6$-alcohols, of amino-containing (meth) acrylamides, in particular N,N-di-$C_1$-$C_4$-alkyl-amino-$C_2$-$C_6$-alkylamides of (meth)acrylic acid, and of diallylalkylamines, in particular diallyl-$C_1$-$C_4$-alkylamines.

Suitable monomers B have the formula IIa to IIc:

IIa

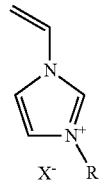

IIb

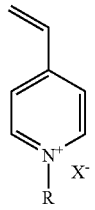

IIc

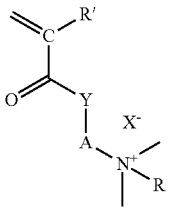

wherein R of formula IIa to IId is selected from $C_1$-$C_4$-alkyl or benzyl, preferably methyl, ethyl or benzyl; R' of formula IIc is selected from hydrogen or methyl; Y of formula IIc is selected from —O— or —NH—; A of formula IIc is selected from $C_1$-$C_6$-alkylene, preferably straight-chain or branched $C_2$-$C_4$-alkylene, in particular 1,2-ethylene, 1,3- and 1,2-propylene or 1,4-butylene; X— of formula IIa to IId is selected from halide, such as iodide and preferably chloride or bromide, $C_1$-$C_4$-alkyl sulfate, preferably methyl sulfate or ethyl sulfate, $C_1$-$C_4$-alkylsulfonate, preferably methylsulfonate or ethylsulfonate, $C_1$-$C_4$-alkyl carbonate; and mixtures thereof.

Specific examples of preferred monomer B that may be utilized in the present invention are:

(a) 3-methyl-1-vinylimidazolium chloride, 3-methyl-1-vinylimidazolium methyl sulfate, 3-ethyl-1-vinylimidazolium ethyl sulfate, 3-ethyl-1-vinylimidazolium chloride and 3-benzyl-1-vinylimidazolium chloride;

(b) 1-methyl-4-vinylpyridinium chloride, 1-methyl-4-vinylpyridinium methyl sulfate and 1-benzyl-4-vinylpyridinium chloride;

(c) 3-methacrylamido-N,N,N-trimethylpropan-1-aminium chloride, 3-acryl-N,N,N-trimethylpropan-1-aminium chloride, 3-acryl-N,N,N-trimethylpropan-1-aminium methylsulfate, 3-methacryl-N,N,N-trimethylpropan-1-aminium chloride, 3-methacryl-N,N,N-trimethylpropan-1-aminium methylsulfate, 2-acrylamido-N,N,N-trimethylethan-1-aminium chloride, 2-acryl-N,N,N-trimethylethan-1-aminium chloride, 2-acryl-N,N,N-trimethylethan-1-aminium methyl sulfate, 2-methacryl-N,N,N-trimethylethan-1-aminium chloride, 2-methacryl-N,N,N-trimethylethan-1-aminium methyl sulfate, 2-acryl-N,N-dimethyl-N-ethylethan-1-aminium ethylsulfate, 2-methacryl-N,N-dimethyl-N-ethylethan-1-aminium ethylsulfate, and (d) dimethyldiallylammonium chloride and diethyldiallylammonium chloride.

A preferred monomer B is selected from 3-methyl-1-vinylimidazolium chloride, 3-methyl-1-vinylimidazolium methyl sulfate, 3-methacryl-N,N,N-trimethylpropan-1-aminium chloride, 2-methacryl-N,N,N-trimethylethan-1-aminium chloride, 2-methacryl-N,N-dimethyl-N-ethylethan-1-aminium ethylsulfate, and dimethyldiallylammonium chloride.

The copolymer according to the invention comprises 1% to 40% by weight, preferably 2% to 30%, and especially preferable from 5 to 20% by weight of the copolymer, of Monomer B. The weight ratio of Monomer A to Monomer B is preferably equal to or greater than 2:1, preferably 3:1 to 5:1.

Monomer C

As optional components of the copolymer of the present invention, monomers C and D may also be utilized. Monomer C is selected from anionic monoethylenically unsaturated monomers. Suitable monomer C may be selected from:

(a) α,β-unsaturated monocarboxylic acids which preferably have 3 to 6 carbon atoms, such as acrylic acid, methacrylic acid, 2-methylenebutanoic acid, crotonic acid and vinylacetic acid, preference being given to acrylic acid and methacrylic acid;

(b) unsaturated dicarboxylic acids, which preferably have 4 to 6 carbon atoms, such as itaconic acid and maleic acid, anhydrides thereof, such as maleic anhydride;

(c) ethylenically unsaturated sulfonic acids, such as vinylsulfonic acid, acrylamidopropanesulfonic acid, methallylsulfonic acid, methacrylsulfonic acid, m- and p-styrenesulfonic acid, (meth)acrylamidomethanesulfonic acid, (meth)acrylamidoethanesulfonic acid, (meth)acrylamidopropanesulfonic acid, 2-(meth)acrylamido-2-methylpropanesulfonic acid, 2-acrylamido-2-butanesulfonic acid, 3-methacrylamido-2-hydroxypropanesulfonic acid, methanesulfonic acid acrylate, ethanesulfonic acid acrylate, propanesulfonic acid acrylate, allyloxybenzenesulfonic acid, methallyloxybenzenesulfonic acid and 1-allyloxy-2-hydroxypropanesulfonic acid; and (d) ethylenically unsaturated phosphonic acids, such as vinylphosphonic acid and m- and p-styrenephosphonic acid.

The anionic Monomer C can be present in the form of water soluble free acids or in water-soluble salt form, especially in the form of alkali metal and ammonium, in particular alkylammonium, salts, and preferred salts being the sodium salts.

A preferred Monomer C may be selected from acrylic acid, methacrylic acid, maleic acid, vinylsulfonic acid, 2-(meth)acrylamido-2-methylpropanesulfonic acid and vinylphosphonic acid, particular preference being given to acrylic acid, methacrylic acid and 2-acrylamido-2-methylpropanesulfonic acid.

The proportion of monomer C in the copolymer of the invention can be up to 15% by weight, preferably from 1% to 5% by weight of the copolymer.

If monomer C is present in the copolymer of the present invention, then, the molar ratio of monomer B to monomer C is greater than 1. The weight ratio of Monomer A to monomer C is preferably equal to or greater than 4:1, more preferably equal to or greater than 5:1. Additionally, the weight ratio of monomer B to monomer C is equal or greater than 2:1, and even more preferable from 2.5:1

Monomer D

As an optional component of the copolymer of the present invention, monomer D may also be utilized. Monomer D is selected from nonionic monoethylenically unsaturated monomers selected from:

(a) esters of monoethylenically unsaturated $C_3$-$C_6$-carboxylic acids, especially acrylic acid and methacrylic acid, with monohydric $C_1$-$C_{22}$-alcohols, in particular $C_1$-$C_{16}$-alcohols; and hydroxyalkyl esters of monoethylenically unsaturated $C_3$-$C_6$-carboyxlic acids, especially acrylic acid and methacrylic acid, with divalent $C_2$-$C_4$-alcohols, such as methyl (meth)acrylate, ethyl (meth)acrylate, n-butyl (meth)acrylate, sec-butyl (meth)acrylate, tert-butyl (meth)acrylate, ethylhexyl (meth)acrylate, decyl (meth)acrylate, lauryl (meth) acrylate, isobornyl (meth)acrylate, cetyl (meth)acrylate, palmityl (meth)acrylate and stearyl (meth)acrylate, hydroxyethyl (meth)acrylate, hydroxypropyl (meth)acrylate and hydroxybutyl (meth)acrylate;

(b) amides of monoethylenically unsaturated $C_3$-$C_6$-carboxylic acids, especially acrylic acid and methacrylic acid, with $C_1$-$C_{12}$-alkylamines and di($C_1$-$C_4$-alkyl) amines, such as N-methyl(meth)acrylamide, N,N-dimethyl(meth)acrylamide, N-ethyl(meth)acrylamide, N-propyl(meth)acrylamide, N-tert-butyl(meth)acrylamide, N-tert-octyl(meth)acrylamide and N-undecyl (meth)acrylamide, and (meth)acrylamide;

(c) vinyl esters of saturated $C_2$-$C_{30}$-carboxylic acids, in particular $C_2$-$C_{14}$-carboxylic acids, such as vinyl acetate, vinyl propionate, vinyl butyrate, vinyl 2-ethylhexanoate and vinyl laurate;

(d) vinyl $C_1$-$C_{30}$-alkyl ethers, in particular vinyl $C_1$-$C_{18}$-alkyl ethers, such as vinyl methyl ether, vinyl ethyl ether, vinyl n-propyl ether, vinyl isopropyl ether, vinyl n-butyl ether, vinyl isobutyl ether, vinyl 2-ethylhexyl ether and vinyl octadecyl ether;

(e) N-vinylamides and N-vinyllactams, such as N-vinylformamide, N-vinyl-N-methyl-formamide, N-vinylacetamide, N-vinyl-N-methylacetamide, N-vinylimidazol, N-vinylpyrrolidone, N-vinylpiperidone and N-vinylcaprolactam;

(f) aliphatic and aromatic olefins, such as ethylene, propylene, $C_4$-$C_{24}$-α-olefins, in particular $C_4$-$C_{16}$-α-olefins, e.g. butylene, isobutylene, diisobutene, styrene and α-methylstyrene, and also diolefins with an active double bond, e.g. butadiene;

(g) unsaturated nitriles, such as acrylonitrile and methacrylonitrile.

A preferred monomer D is selected from methyl (meth) acrylate, ethyl (meth)acrylate, (meth)acrylamide, vinyl acetate, vinyl propionate, vinyl methyl ether, N-vinylformamide, N-vinylpyrrolidone, N-vinylimidazole and N-vinylcaprolactam. N-vinylimidazol is particularly preferred.

If the monomer D is present in the copolymer of the present invention, then the proportion of monomer D may be up to 40%, preferably from 1% to 30%, more preferably from 5% to 20% by weight of the copolymer.

Preferred copolymers of the present invention include:

(1)

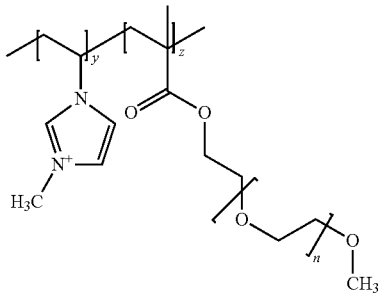

-continued (2)

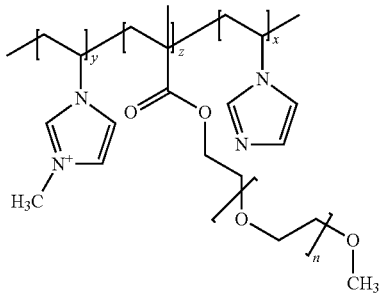

wherein indices y and z are such that the monomer ratio (z:y) is from 3:1 to 20:1 and the inidces x and z are such that the monomer ratio (z:x) is from 1.5:1 to 20:1, and the polymer has a weight average molecular weight of from 20,000 to 500,000 g/mol, preferably from greater than 25,000 to 150,000 g/mol and especially from 30,000 to 80,000 g/mol.

The copolymers according to the invention can be prepared by free-radical polymerization of the Monomers A and B and if desired C and/or D. The free-radical polymerization of the monomers can be carried out in accordance with all known methods, preference being given to the processes of solution polymerization and of emulsion polymerization. Suitable polymerization initiators are compounds which decompose thermally or photochemically (photoinitiators) to form free radicals, such as benzophenone, acetophenone, benzoin ether, benzyl dialkyl ketones and derivatives thereof.

The polymerization initiators are used according to the requirements of the material to be polymerized, usually in amounts of from 0.01% to 15%, preferably 0.5% to 5% by weight based on the monomers to be polymerized, and can be used individually or in combination with one another.

Instead of a quaternized Monomer B, it is also possible to use the corresponding tertiary amines. In this case, the quaternization is carried out after the polymerization by reacting the resulting copolymer with alkylating agents, such as alkyl halides, dialkyl sulfates and dialkyl carbonates, or benzyl halides, such as benzyl chloride. Examples of suitable alkylating agents which may be mentioned are, methyl chloride, bromide and iodide, ethyl chloride and bromide, dimethyl sulfate, diethyl sulfate, dimethyl carbonate and diethyl carbonate.

The anionic monomer C can be used in the polymerization either in the form of the free acids or in a form partially or completely neutralized with bases. Specific examples that may be listed are: sodium hydroxide solution, potassium hydroxide solution, sodium carbonate, sodium hydrogen carbonate, ethanolamine, diethanolamine and triethanolamine.

To limit the molar masses of the copolymers according to the invention, customary regulators can be added during the polymerization, e.g. mercapto compounds, such as mercaptoethanol, thioglycolic acid and sodium disulfite. Suitable amounts of regulator are 0.1% to 5% by weight based on the monomers to be polymerized.

Surfactant

The total amount of surfactant is from 0.1 to 25, preferably 2 to 20, more preferably from 3 to 15 and most preferably from 5 to 12% by weight of the composition. Preferred surfactants include non-ionic surfactant, anionic surfactant, and combinations thereof, though additional surfactants can be present.

If both anionic and non-ionic surfactant is present, the weight ratio of anionic surfactant to non-ionic surfactant is preferably from 0.06 to 1.00, more preferably from 0.08 to 0.80, more preferably from 0.10 to 0.60, and most preferably from 0.12 to 0.50.

Non-Ionic Surfactant

The liquid hard surface cleaning composition preferably comprises a non-ionic surfactant. The non-ionic surfactant can be selected from the group consisting of: alkoxylated non-ionic surfactants, alkyl polyglycosides, amine oxides, and mixture thereof. Typically, the liquid hard surface cleaning composition may comprise from 1.0 wt % to 10.0 wt % by weight of the total composition of said non-ionic surfactant, preferably from 3.0 wt % to 9.5 wt %, more preferably from 4.0 wt % to 9.0 wt % and most preferably from 5.0 wt % to 8.0 wt %.

For dilute compositions, comprising a total amount of surfactant of from 2 to 10 wt %, preferably from 2 to 5 wt %, the non-ionic surfactant is preferably present at a level of from 1.0 wt % to 5.0 wt %, more preferably from 2.0 wt % to 4.0 wt %, most preferably from 2.2 wt % to 3.5 wt % of the liquid hard surface cleaning composition.

The combination of the copolymer with non-ionic surfactant results in improved shine, in addition to reduced drying time.

For improved shine, the copolymer and the non-ionic surfactant are present in a weight ratio of from 0.03 to 0.5, preferably from 0.035 to 0.2 and more preferably from 0.04 to 0.09.

The hard surface cleaning composition can comprise from 1 wt % to 10 wt %, preferably from 1.5 wt % to 8 wt %, more preferably from 2 wt % to 7 wt % and most preferably from 2 wt % to 6 wt % of the composition of alkoxylated alcohol, preferably ethoxylated alcohol.

Suitable alkoxylated non-ionic surfactants include primary $C_6$-$C_{16}$ alcohol polyglycol ether i.e. ethoxylated alcohols having 6 to 16 carbon atoms in the alkyl moiety and 4 to 30 ethylene oxide (EO) units. When referred to for example $C_{9-14}$ it is meant average carbons and alternative reference to for example EO8 is meant average ethylene oxide units.

Suitable alkoxylated non-ionic surfactants are according to the formula RO-$(A)_nH$, wherein: R is a $C_6$ to $C_{18}$, preferably a $C_8$ to $C_{16}$, more preferably a $C_8$ to $C_{12}$ alkyl chain, or a $C_6$ to $C_{28}$ alkyl benzene chain; A is an ethoxy or propoxy or butoxy unit, and wherein n is from 1 to 30, preferably from 1 to 15 and, more preferably from 4 to 12 even more preferably from 5 to 10. Preferred R chains for use herein are the $C_8$ to $C_{22}$ alkyl chains. Even more preferred R chains for use herein are the $C_9$ to $C_{12}$ alkyl chains. R can be linear or branched alkyl chain.

Suitable ethoxylated non-ionic surfactants for use herein are Dobanol® 91-2.5 (HLB=8.1; R is a mixture of $C_9$ and $C_{11}$ alkyl chains, n is 2.5), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), Greenbentine DE80 (HLB=13.8, 98 wt % C10 linear alkyl chain, n is 8), Marlipal 10-8 (HLB=13.8, R is a C10 linear alkyl chain, n is 8), Lialethl® 11-5 (R is a $C_{11}$ alkyl chain, n is 5), Isalchem® 11-5 (R is a mixture of linear and branched C11 alkyl chain, n is 5), Lialethl® 11-21 (R is a mixture of linear and branched $C_{11}$ alkyl chain, n is 21), Isalchem® 11-21 (R is a $C_{11}$ branched alkyl chain, n is 21), Empilan® KBE21 (R is a mixture of $C_{12}$ and $C_{14}$ alkyl chains, n is 21) or mixtures thereof. Preferred herein are Dobanol® 91-5, Neodol® 11-5, Lialethl® 11-21 Lialethl® 11-5 Isalchem® 11-5 Isalchem® 11-21 Dobanol® 91-8, or Dobanol® 91-10, or Dobanol® 91-12, or mixtures thereof. These Dobanol®/Neodol® surfactants are commercially available from SHELL. The Greenbentine® surfactant is commercially available from KOLB. These Isalchem®/Marlipal® surfactants are commercially available from Sasol. The Empilan® surfactants are commercially available from Huntsman.

Suitable chemical processes for preparing the alkoxylated non-ionic surfactants for use herein include condensation of corresponding alcohols with alkylene oxide, in the desired proportions. Such processes are well known to the person skilled in the art and have been extensively described in the art, including the OXO process and various derivatives thereof. Suitable alkoxylated fatty alcohol non-ionic surfactants, produced using the OXO process, have been marketed under the tradename NEODOL® by the Shell Chemical Company. Alternatively, suitable alkoxylated non-ionic surfactants can be prepared by other processes such as the Ziegler process, in addition to derivatives of the OXO or Ziegler processes.

Preferably, said alkoxylated non-ionic surfactant is a $C_{9-11}$ EO5 alkylethoxylate, $C_{12-14}$ EO5 alkylethoxylate, a $C_{11}$ EO5 alkylethoxylate, $C_{12-14}$ EO21 alkylethoxylate, or a $C_{9-11}$ EO8 alkylethoxylate or a mixture thereof. Most preferably, said alkoxylated non-ionic surfactant is a $C_{11}$ EO5 alkylethoxylate or a $C_{9-11}$ EO8 alkylethoxylate or a mixture thereof.

Alkyl polyglycosides are biodegradable non-ionic surfactants which are well known in the art, and can also be used in the compositions of the present invention. Suitable alkyl polyglycosides can have the general formula $C_nH_{2n+1}O(C_6H_{10}O_5)_xH$ wherein n is preferably from 9 to 16, more preferably 11 to 14, and x is preferably from 1 to 2, more preferably 1.3 to 1.6.

Suitable amine oxide surfactants include: $R_1R_2R_3NO$ wherein each of $R_1$, $R_2$ and $R_3$ is independently a saturated or unsaturated, substituted or unsubstituted, linear or branched hydrocarbon chain having from 10 to 30 carbon atoms. Preferred amine oxide surfactants are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain. Preferably, the liquid hard surface cleaning composition comprises from 0.05 wt % to 6 wt %, preferably from 0.1 wt % to 5 wt %, more preferably from 0.1 wt % to 4.5 wt % and most preferably from 0.1 wt % to 4 wt % of the composition of amine oxide surfactant.

A highly preferred amine oxide is $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel.

The non-ionic surfactant is preferably a low molecular weight non-ionic surfactant, having a molecular weight of less than 950 g/mol, more preferably less than 500 g/mol.

Anionic Surfactant:

The liquid hard surface cleaning composition can comprise an anionic surfactant. The anionic surfactant can be selected from the group consisting of: an alkyl sulphate, an alkyl alkoxylated sulphate, a sulphonic acid or sulphonate surfactant, and mixtures thereof. The liquid hard surface cleaning composition can comprise from 0.05 wt % to 5 wt %, preferably from 0.1 wt % to 4 wt %, and most preferably from 1.5 wt % to 3.5 wt % of anionic surfactant.

Suitable alkyl sulphates for use herein include water-soluble salts or acids of the formula $ROSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphates include $C_{12-14}$ alkyl sulphate like EMPICOL® 0298/, EMPICOL® 0298/F or EMPICOL® XLB commercially available from Huntsman. By "linear alkyl sulphate" it is meant herein a non-substituted alkyl sulphate wherein the linear alkyl chain comprises from 6 to 16 carbon atoms, preferably from 8 to 14 carbon atoms, and more preferably from 10 to 14 carbon atoms, and wherein this alkyl chain is sulphated at one terminus.

Suitable sulphonated anionic surfactants for use herein are all those commonly known by those skilled in the art. Preferably, the sulphonated anionic surfactants for use herein are selected from the group consisting of: alkyl sulphonates; alkyl aryl sulphonates; naphthalene sulphonates; alkyl alkoxylated sulphonates; and $C_6$-$C_{16}$ alkyl alkoxylated linear or branched diphenyl oxide disulphonates; and mixtures thereof.

Suitable alkyl sulphonates for use herein include water-soluble salts or acids of the formula $RSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{18}$ linear or branched saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphonates include $C_{12}$-$C_{16}$ paraffin sulphonate like Hostapur® SAS commercially available from Clariant. Particularly preferred alkyl aryl sulphonates are alkyl benzene sulphonates commercially available under trade name Nansa® available from Huntsman.

By "linear alkyl sulphonate" it is meant herein a non-substituted alkyl sulphonate wherein the alkyl chain comprises from 6 to 18 carbon atoms, preferably from 8 to 16 carbon atoms, and more preferably from 10 to 16 carbon atoms, and wherein this alkyl chain is sulphonated at one terminus.

Suitable alkoxylated sulphonate surfactants for use herein are according to the formula $R(A)_mSO_3M$, wherein R is an unsubstituted $C_6$-$C_{18}$ alkyl, hydroxyalkyl or alkyl aryl group, having a linear or branched $C_6$-$C_{18}$ alkyl component, preferably a $C_8$-$C_{16}$ alkyl or hydroxyalkyl, more preferably $C_{12}$-$C_{16}$ alkyl or hydroxyalkyl, and A is an ethoxy or propoxy or butoxy unit, and m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like.

Exemplary surfactants are $C_{12}$-$C_{18}$ alkyl polyethoxylate (1.0) sulphonate ($C_{12}$-$C_{18}$E(1.0)SM), $C_{12}$-$C_{18}$ alkyl polyethoxylate (2.25) sulphonate ($C_{12}$-$C_{18}$E(2.25)SM), $C_{12}$-$C_{18}$ alkyl polyethoxylate (3.0) sulphonate ($C_{12}$-$C_{18}$E(3.0)SM), and $C_{12}$-$C_{18}$ alkyl polyethoxylate (4.0) sulphonate ($C_{12}$-$C_{18}$E(4.0)SM), wherein M is conveniently selected from sodium and potassium. Particularly suitable alkoxylated sulphonates include alkyl aryl polyether sulphonates like Triton X-200® commercially available from Dow Chemical.

Preferably said sulphated or sulphonated anionic surfactant for use herein is selected from the group consisting of alkyl sulphates (AS) preferably $C_{12}$, $C_{13}$, $C_{14}$ and $C_{15}$ AS, sodium linear alkyl sulphonate (NaLAS), sodium paraffin sulphonate $NaPC_{12-16}S$, and mixtures thereof. Most preferably sulphated or sulphonated anionic surfactant for use herein is selected from the group consisting of alkyl sulphates (AS) preferably, $C_{12}$, $C_{13}$, $C_{14}$ and $C_{15}$ AS, sodium linear alkyl sulphonate (NaLAS), sodium paraffin sulphonate $NaPC_{12-16}S$ and mixtures thereof.

Typically, the liquid composition herein may comprise from 0.5% to 9.5% by weight of the total composition of said sulphated or sulphonated anionic surfactant, preferably from 1.0% to 5.0%, more preferably from 1.5% to 3.5% and most preferably from 2.0% to 3.0%.

Additional Surfactant:

The hard surface cleaning composition may comprise up to 10% by weight of an additional surfactant, preferably selected from: an amphoteric, zwitterionic, and mixtures thereof. More preferably, the hard surface cleaning composition can comprise from 0.5% to 5%, or from 0.5% to 3%, or from 0.5% to 2% by weight of the additional surfactant.

Suitable zwitterionic surfactants typically contain both cationic and anionic groups in substantially equivalent proportions so as to be electrically neutral at the pH of use, and are well known in the art. Some common examples of zwitterionic surfactants (such as betaine/sulphobetaine surfacants) are described in U.S. Pat. Nos. 2,082,275, 2,702,279 and 2,255,082.

Amphoteric surfactants can be either cationic or anionic depending upon the pH of the composition. Suitable amphoteric surfactants include dodecylbeta-alanine, N-alkyltaurines such as the one prepared by reacting dodecylamine with sodium isethionate, as taught in U.S. Pat. No. 2,658,072, N-higher alkylaspartic acids such as those taught in U.S. Pat. No. 2,438,091, and the products sold under the trade name "Miranol", as described in U.S. Pat. No. 2,528,378. Other suitable additional surfactants can be found in McCutcheon's Detergents and Emulsifers, North American Ed. 1980.

Optional Ingredients:

Thickener:

The liquid hard surface cleaning composition can comprise a thickener. An increased viscosity, especially low shear viscosity, provides longer contact time and therefore improved penetration of greasy soil and/or particulated greasy soil to improve cleaning effectiveness, especially when applied neat to the surface to be treated. Moreover, a high low shear viscosity improves the phase stability of the liquid cleaning composition, and especially improves the stability of the copolymer in compositions in the liquid hard surface cleaning composition. Hence, preferably, the liquid hard surface cleaning composition, comprising a thickener, has a viscosity of from 50 Pa·s to 650 Pa·s, more preferably 100 Pa·s to 550 Pa·s, most preferably 150 Pa·s to 450 Pa·s, at 20° C. when measured with a AD1000 Advanced Rheometer from Atlas® shear rate 10 $s^{-1}$ with a coned spindle of 40 mm with a cone angle 2° and a truncation of ±60 μm.

Suitable thickeners include polyacrylate based polymers, preferably hydrophobically modified polyacrylate polymers; hydroxyl ethyl cellulose, preferably hydrophobically modified hydroxyl ethyl cellulose, xanthan gum, hydrogenated castor oil (HCO) and mixtures thereof.

Preferred thickeners are polyacrylate based polymers, preferably hydrophobically modified polyacrylate polymers. Preferably a water soluble copolymer based on main monomers acrylic acid, acrylic acid esters, vinyl acetate, methacrylic acid, acrylonitrile and mixtures thereof, more preferably copolymer is based on methacrylic acid and acrylic acid esters having appearance of milky, low viscous dispersion. Most preferred hydrologically modified polyacrylate polymer is Rheovis® AT 120, which is commercially available from BASF.

The most preferred thickener used herein is a methacrylic acid/acrylic acid copolymer, such as Rheovis® AT 120, which is commercially available from BASF.

When used, the liquid hard surface cleaning composition comprises from 0.1% to 10.0% by weight of the total composition of said thickener, preferably from 0.2% to 5.0%, more preferably from 0.2% to 2.5% and most preferably from 0.2% to 2.0%.

Chelating Agent:

The liquid hard surface cleaning composition can comprise a chelating agent or crystal growth inhibitor. Suitable chelating agents, in combination with the surfactant system, improve the shine benefit. Chelating agent can be incorporated into the compositions in amounts ranging from 0.05% to 5.0% by weight of the total composition, preferably from 0.1% to 3.0%, more preferably from 0.2% to 2.0% and most preferably from 0.2% to 0.4%.

Suitable phosphonate chelating agents include ethylene diamine tetra methylene phosphonates, and diethylene triamine penta methylene phosphonates (DTPMP), and can be present either in their acid form or as salts.

A preferred biodegradable chelating agent for use herein is ethylene diamine N,N'-disuccinic acid, or alkali metal, or alkaline earth, ammonium or substitutes ammonium salts thereof or mixtures thereof, for instance, as described in U.S. Pat. No. 4,704,233. A more preferred biodegradable chelating agent is L-glutamic acid N,N-diacetic acid (GLDA) commercially available under tradename Dissolvine 47S from Akzo Nobel.

Suitable amino carboxylates to be used herein include tetra sodium glutamate diacetate (GLDA), ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraaminehexa-acetates, ethanoldiglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FSO methyl glycine di-acetic acid (MGDA), tetra sodium glutamate diacetate (GLDA) which is, for instance, commercially available from AkzoNobel under the trade name Dissolvine® GL.

Additional Polymers:

The liquid hard surface cleaning composition may comprise an additional polymer. It has been found that the presence of a specific polymer as described herein, when present, allows further improving the grease removal performance of the liquid composition due to the specific sudsing/foaming characteristics they provide to the composition. Suitable polymers for use herein are disclosed in co-pending EP patent application EP2272942 (09164872.5) and granted European patent EP2025743 (07113156.9).

The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; and mixtures thereof.

Typically, the liquid hard surface cleaning composition may comprise from 0.005% to 5.0% by weight of the total composition of said polymer, preferably from 0.10% to 4.0%, more preferably from 0.1% to 3.0% and most preferably from 0.20% to 1.0%.

Fatty Acid:

The liquid hard surface cleaning composition may comprise a fatty acid as a highly preferred optional ingredient, particularly as suds suppressors. Fatty acids are desired herein as they reduce the sudsing of the liquid composition when the composition is rinsed off the surface to which it has been applied.

Suitable fatty acids include the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms. Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil. For example coconut fatty acid is commercially available from KLK OLEA under the name PALMERAB1211.

Typically, the liquid hard surface cleaning composition may comprise up to 6.0% by weight of the total composition of said fatty acid, preferably from 0.1% to 3.0%, more preferably from 0.1% to 2.0% and most preferably from 0.15% to 1.5% by weight of the total composition of said fatty acid.

Branched Fatty Alcohol:

The liquid hard surface cleaning composition may comprise a branched fatty alcohol, particularly as suds suppressors. Suitable branched fatty alcohols include the 2-alkyl alkanols having an alkyl chain comprising from 6 to 16, preferably from 7 to 13, more preferably from 8 to 12, most preferably from 8 to 10 carbon atoms and a terminal hydroxy group, said alkyl chain being substituted in the $\alpha$ position (i.e., position number 2) by an alkyl chain comprising from 1 to 10, preferably from 2 to 8 and more preferably 4 to 6 carbon atoms. Such suitable compounds are commercially available, for instance, as the Isofol® series such as Isofol® 12 (2-butyl octanol) or Isofol® 16 (2-hexyl decanol) commercially available from Sasol Typically, the liquid hard surface cleaning composition may comprise up to 2.0% by weight of the total composition of said branched fatty alcohol, preferably from 0.10% to 1.0%, more preferably from 0.1% to 0.8% and most preferably from 0.1% to 0.5%.

Solvent:

The liquid hard surface cleaning compositions preferably comprises a solvent. Suitable solvents may be selected from the group consisting of: ethers and diethers having from 4 to 14 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof.

Other Optional Ingredients:

The liquid hard surface cleaning compositions may comprise a variety of other optional ingredients depending on the technical benefit aimed for and the surface treated. Suitable optional ingredients for use herein include perfume, builders, other polymers, buffers, bactericides, hydrotropes, colorants, stabilisers, radical scavengers, abrasives, soil suspenders, brighteners, anti-dusting agents, dispersants, dye transfer inhibitors, pigments, silicones and/or dyes.

Method of Cleaning a Surface:

Liquid hard surface cleaning compositions comprising the copolymer and preferably at least one detersive surfactant, especially the compositions of the present invention, are suitable for cleaning household surfaces. In particular, such compositions are particularly useful for reducing drying time of hard surfaces, especially of floors. Suitable detersive surfactants can be selected from the group consisting of: anionic surfactant, non-ionic surfactant, and mixtures thereof.

For general cleaning, especially of floors, the preferred method of cleaning comprises the steps of:

a) optionally diluting the liquid hard surface cleaning composition;
b) applying the liquid hard surface cleaning composition to a hard surface; and
c) optionally rinsing.

The liquid hard surface composition can be formulated as a spray. As such, the liquid hard surface cleaning composition can be applied to the hard surface via spraying.

In particular embodiments, the liquid hard surface cleaning composition may be diluted to a level of from 0.3% to 1.5% by volume. The liquid hard surface cleaning composition may be diluted to a level of from 0.4% to 0.6% by volume, especially where the liquid hard surface cleaning composition has a total surfactant level of greater than or equal to 5% by weight. Where the liquid hard surface cleaning composition has a total surfactant level of less than 5% by weight, the liquid hard surface cleaning composition may be diluted to a level of from 0.7% to 1.4% by volume. In preferred embodiments, the liquid hard surface cleaning composition is diluted with water.

The dilution level is expressed as a percent defined as the fraction of the liquid hard surface cleaning composition, by volume, with respect to the total amount of the diluted composition. For example, a dilution level of 5% by volume is equivalent to 50 ml of the liquid hard surface cleaning composition being diluted to form 1000 ml of diluted composition.

The diluted composition can be applied by any suitable means, including using a mop, sponge, or other suitable implement.

The hard surface may be rinsed, preferably with clean water, in an optional further step. Liquid hard surface cleaning compositions comprising the copolymer and at least one other detersive surfactant, especially the compositions of the present invention, result in improved drying time of the diluted composition applied to the hard surface, and also of any rinse solution which is applied as a further step, both when left to dry and also when wiped, such as with a cloth.

Alternatively, and especially for particularly dirty or greasy spots, the liquid hard surface cleaning compositions comprising the copolymer and at least one other detersive surfactant, especially the compositions of the present invention, can be applied neat to the hard surface. It is believed that the improved surface wetting, provided by the copolymer, results in improved penetration of the stain, and especially greasy stains, leading to improved surfactancy action and stain removal.

By "neat", it is to be understood that the liquid composition is applied directly onto the surface to be treated without undergoing any significant dilution, i.e., the liquid composition herein is applied onto the hard surface as described herein, either directly or via an implement such as a sponge, without first diluting the composition. By significant dilution, what is meant is that the composition is diluted by less than 10 wt %, preferably less than 5 wt %, more preferably less than 3 wt %. Such dilutions can arise from the use of damp implements to apply the composition to the hard surface, such as sponges which have been "squeezed" dry.

In another preferred embodiment of the present invention said method of cleaning a hard surface includes the steps of applying, preferably spraying, said liquid composition onto said hard surface, leaving said liquid composition to act onto said surface for a period of time to allow said composition to act, with or without applying mechanical action, and optionally removing said liquid composition, preferably removing said liquid composition by rinsing said hard surface with water and/or wiping said hard surface with an appropriate instrument, e.g., a sponge, a paper or cloth towel and the like.

The compositions of the present invention can also be used for improving surface shine, since the beading of the composition results in less residue formation on the treated surface, and also greater removal of residues when the surface is wiped.

Methods:

A) pH Measurement:

The pH is measured on the neat composition, at 25° C., using a Sartarius PT-10P pH meter with gel-filled probe (such as the Toledo probe, part number 52 000 100), calibrated according to the instructions manual.

B) Drying Time:

The drying test is done on a standard test surface, which is a black glossy tile (Sphinx Highlight Black, 20 cm×20 cm, available from Carobati Boomsesteenweg 36, 2630 Aartselaar, Belgium). The black tiles are washed with an all-purpose cleaner, not containing any polymer (Mr. Propre APC, commercially available) and thoroughly rinse with tap water until they are completely free of any residue. The tiles are then dried with a paper towel. The tiles are then placed vertically (with a slight inclination of up to 5 degrees) resting on a suitable support.

With a plastic disposable pipette, 3 mL of the solution are then applied at the top of the tile with a swift motion from the top left to the top right corner. The product is then immediately spread evenly across the surface of the tile, with at least four vertical strokes followed by four horizontal strokes using a cellulose sponge. (The sponges have been washed at 95 C three times in a domestic washing machine, without any detergent, prior to the experiment). The product is allowed to remain on the surface for 15 seconds.

Once this time has passed, the tiles are then thoroughly rinsed for 30 seconds using a showerhead with a water flow of 4 L/min. The tiles are then allowed to dry, measuring the time it takes for the water to evaporate. Once the tiles are dry the shine of the tiles washed with the composition of the invention is compared to the shine of the tile washed with the reference composition. A visual grading system is used, going from 0 to 5, where 0 means perfect sparkling and clear surface and 5 means cloudy surface with visible streaks and water marks.

The rinsing steps are then repeated, measuring the time it takes to dry and evaluating the shine once they are dry, the tiles are dried in a controlled temperature and humidity room at 20° C. and a relative humidity of 40%. The procedure is repeated twice and the average values reported.

EXAMPLES

To illustrate the shorter drying times and improved shine obtained with the compositions of the invention, the next protocol was followed. Three compositions were prepared, compositions A and B according to the invention and composition C as a reference composition outside the scope of the invention. The compositions are prepared in a glass beaker with magnetic agitation at 500 rpm. The values are reported as percent of active raw material.

| Ingredient | Composition A According to the invention | Composition B According to the invention | Composition C Reference |
|---|---|---|---|
| | % of active raw material | | |
| Water | Balance up to 100 | Balance up to 100 | Balance up to 100 |
| Non-ionic surfactant [1] | 5.270 | 5.270 | 5.270 |
| Anionic surfactant [2] | 1.530 | 1.530 | 1.530 |
| C12-C14 Amine Oxide | 1.275 | 1.275 | 1.275 |
| Perfume | 0.900 | 0.900 | 0.900 |
| TPK Fatty acid [3] | 0.850 | 0.850 | 0.850 |
| Sodium Hydroxide | 0.605 | 0.605 | 0.605 |
| Rheology modifier [4] | 0.600 | 0.600 | 0.600 |
| Sodium Carbonate | 0.468 | 0.468 | 0.468 |
| Citric Acid | 0.255 | 0.255 | 0.255 |
| DTPMP [5] | 0.255 | 0.255 | 0.255 |
| Polymer A [8] | 0.100 | — | — |
| Polymer B [9] | — | 0.100 | — |
| Aesthetic dye | 0.100 | 0.100 | 0.100 |
| 2-Butyl-1-octanol [6] | 0.085 | 0.085 | 0.085 |
| Glutaraldehyde | 0.009 | 0.009 | 0.009 |
| 1,2-benzisothiazolin-3-one [7] | 0.005 | 0.005 | 0.005 |

[1] Non-ionic surfactant is C9-C11 EO, sourced as Neodol ® 91-8 from Shell.
[2] Anionic surfactant is HLAS.
[3] Topped palm kernel fatty acid source from AkzoNobel.
[4] Copolymer based on methacrylic and acrylic acid esters, Rheovis ® AT 120 from BASF
[5] Diethylenetriamine penta(methylene phosphonic acid) sodium salt, as Dequest ®-2060
[6] Sourced as Isofol 12 ® from Sasol.
[7] 1,2-benzisothiazolin-3-one is sourced as Proxel ® GXL.
[8] Polymer A is MPEG-25EO/QVI/VI with a 80/10/10 percent weight and 79,200 g/mol
[9] Polymer B is MPEG-25EO/QVI/VI with a 90/5/5 percent weight and 52,425 g/mol The drying time and shine results obtained are reported below:

| | Testing product | | | | | | | |
|---|---|---|---|---|---|---|---|---|
| | Water Drying time (seconds) Water rinses after application | | | | Shine visual grades Water rinses after application | | | |
| | 1 | 2 | 4 | 5 | 1 | 2 | 4 | 5 |
| Composition C | 1,262.5 | 98.5 | 170.0 | 349.5 | 4 | 3 | 3.1 | 4.1 |
| Composition B | 10.5 | 22.5 | 37.0 | 51.5 | 1.5 | 2.5 | 1.6 | 1.8 |
| Composition A | 8.5 | 14.5 | 17.0 | 24.0 | 1.9 | 1.3 | 2.3 | 1.5 |

The results illustrate clearly a reduction on drying time even after five rinses and improved shine vs. the reference.

Examples

Polymer Synthesis

GPC(SEC) Method to Determine the Molecular Weight of the Copolymer:

The weight average molecular weight of the polymers are determined by the technique of Size Exclusion Chromatography (SEC). SEC separation conditions were three hydrophilic Vinylpolymer network gel columns, in distilled water ion the presence of 0.1% (w/w) trifluoroacetic acid/0.1 M NaCl at 35° C. Calibration was done with narrowly distributed Poly(2-vinylpyridine)-standard of company PSS, Deutschland with molecular weights Mw=620 to M=2.070.000.

temperature. The GPC measured following above method gives values of Mw=60,300 g/mol.

The copolymer, described herein, are particularly suitable for use in liquid hard surface cleaning compositions, including the compositions exemplified in examples D to L below:

| | D | E | F | G | H | I | J | K | L |
|---|---|---|---|---|---|---|---|---|---|
| | Percent active weight. | | | | | | | | |
| C9/11 EO8[1] | 1.2 | — | 7.0 | — | — | — | 6.0 | 6.0 | 6.2 |
| C9/11 EO5[2] | — | — | — | 3.5 | — | — | — | — | — |
| C13/15 EO30[3] | — | — | — | 3.5 | — | — | — | — | — |
| C8/10 EO8[4] | 1.2 | 2.4 | — | — | 7.0 | 6.0 | — | — | — |
| NaLAS[5] | 0.4 | 0.6 | 1.8 | — | — | 2.60 | — | 2.25 | 1.80 |
| NAPS[6] | — | — | — | 3.1 | 3.0 | — | 2.60 | — | — |
| C12-14 Amine Oxide[7] | 0.15 | — | 1.50 | 3.9 | 2.0 | 0.5 | 0.5 | 1.25 | 1.50 |
| C12-14 Betaine[8] | — | — | — | — | 1.0 | — | 0.5 | — | — |
| copolymer[9] | 0.2 | 0.03 | 0.1 | 0.5 | 0.4 | 0.3 | 0.5 | 0.7 | 0.5 |
| Hydrophobically modified-polyacrylate[10] | — | — | 0.75 | — | — | — | 0.70 | 0.65 | 0.65 |
| HM-HEC[11] | — | — | — | 0.6 | 0.8 | — | — | — | — |
| Xanthan gum[12] | — | — | — | — | — | 0.42 | — | — | — |
| $Na_2CO_3$ | 0.40 | 0.4 | 0.75 | 0.1 | 0.3 | 0.50 | 0.55 | 0.4 | 0.55 |
| Citric Acid | 0.30 | 0.3 | 0.3 | 0.75 | 0.75 | 0.30 | 0.3 | 0.3 | 0.30 |
| Caustic | 0.25 | 0. 25 | 0.72 | 0.5 | 0.5 | 0.3 | 0.65 | 0.65 | 0.66 |
| Fatty Acid | 0.15 | — | 1.0 | 0.20 | 0.50 | 0.50 | 0.40 | 0.40 | 1.0 |
| 2-butyl octanol[13] | — | 0.2 | 0.1 | 0.2 | 0.3 | 0.5 | — | — | 0.1 |
| 2-hexyl decanol [14] | — | — | — | — | — | — | 0.1 | — | — |
| DTPMP[15] | 0.1 | 0.15 | 0.30 | — | — | 0.2 | — | — | 0.3 |
| DTPA[16] | — | — | — | — | — | — | 0.25 | 0.25 | — |
| GLDA[17] | — | — | — | 0.3 | 0.3 | — | — | — | — |
| IPA[18] | — | — | — | — | — | 2.0 | — | — | — |
| n-BPP[19] | — | — | — | — | 2.0 | — | — | — | — |
| n-BP[20] | — | — | — | 4.0 | 2.0 | — | — | 2.0 | — |
| Minors and Water | up to 100% | | | | | | | | |
| pH | 10.5 | 10.3 | 10.3 | 9.5 | 9.0 | 10.5 | 10.3 | 10.5 | 10.3 |

[1]non-ionic surfactant commercially available from Shell.
[2]non-ionic surfactant commercially available from ICI or Shell.
[3]non-ionic surfactant commercially available from BASF
[4]non-ionic surfactant commercially available from Sasol
[5]sodium linear alkylbenzene sulphonate commercially available from Huntsman
[6]sodium paraffin sulphonate commercially available from ICS
[7]amine oxide non-ionic surfactant commercially available from Huntsman
[8]amphoteric surfactant commercially available from MC Intyre group
[9]copolymer, such as 80/15/5 MPEG EO25/VI/QVI Mw = 60,300 g/mol, or 80/20 MPEG EO45/QVI, Mw = 143,000 g/mol, or 95/05 MPEG EO45/QVI, Mw = 10,800 g/mol or 80/20 MPEG EO45/QVI, Mw = 100,000 g/mol, or 80/20 MPEG EO45/QVI, MW = 179,000 g/mol
[10]Rheovis ® AT 120, which is commercially available from BASF
[11]Hydrophobically modified hydroxyethylcellulose (cetylhydroxethylcellulose)
[12]commercially available from CP Kelco
[13]commercially available from Sasol as Isofol 12 ®.
[14] commercially available from Sasol as Isofol 16 ®.
[15]diethylene triamine penta methylene phosphonate, available from Monsanto
[16]diethylene triamine pentaacetate, available from BASF
[17]Tetrasodium Glutamate Diacetate, commercially available from Akzo Nobel
[18]isopropanol, commercially available from JT Baker
[19]butoxy propoxy propanol, commercially available from Dow Chemicals
[20]normal butoxy propanol commercially available from Dow Chemicals Example polymer according to the invention: MPEG-EO25 units/Vinyl imidazole/Methyl-vinyl-imidazolium, 80/15/5 wt %.

In a 2 L stirred vessel, water (199 g) was charged and heated to 85° C. under a flow of nitrogen. A solution of Wako V50 (3 g, Wako Pure Chemical Industries, Ltd.) in water (47 g) is added over 4 h, a solution of Methoxypolyethylenglycol methacrylate with molecular weight ~1000 g/mol (50%, 484.8 g, Bisiomer S10W, GEO Specialty Chemicals) and 3-Methyl-1-vinyl-1H-imidazolium-methyl-sulfat (45%, 33.3 g, BASF SE), and 1-vinylimidazole (45 g) and water (177.6 g) over 3 hours. The polymerization mixture is kept at this temperature for additional 30 min after the three streams have finished. Subsequently a solution of Wako V50 (1.5 g) in water (23.5 g) is added at once and the reaction stirred for 2 h. Afterwards the reaction cooled down to room The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hard surface cleaning composition comprising a copolymer, wherein the hard surface composition comprises:

a) from about 0.1 to about 25 wt % of an ethoxylated non-ionic surfactant b) from about 0.1 to about 7 wt % of the copolymer comprises:

i. from about 80 to about 90% by weight of at least one monoethylenically unsaturated polyalkylene oxide monomer of the formula I (monomer A)

I

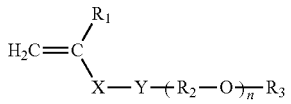

in which the variables have the following meanings:

X is —CO;

Y is —O—;

$R_1$ is hydrogen;

$R_2$ is ethylene, linear or branched propylene or mixtures thereof;

$R_3$ is methyl;

n is an integer from 20 to 50, ii. from about 5 to about 20% by weight of at least one quaternized nitrogen-containing monomer, selected from the group consisting of at least one of the monomers of the formula IIa to IIc (monomer B)

IIa

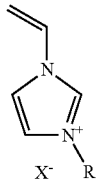

IIb

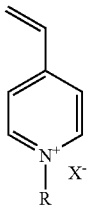

-continued

IIc

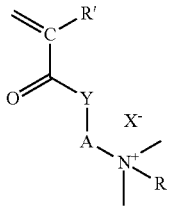

in which the variables have the following meanings:

R is C1-C4 alkyl or benzyl;

R' is hydrogen or methyl;

Y —NH—;

A is C1-C6 alkylene;

$X^-$ is halide, C1-C4-alkyl sulfate, C1-C4-alkylsulfonate and C1-C4-alkyl carbonate, iii. from about 1 to about 5% by weight of at least one anionic monoethylenically unsaturated monomer (monomer C), and iv. from about 5 to about 20% by weight of at least one other non-ionic monoethylenically unsaturated monomer (monomer D), wherein:

the weight ratio of Monomer A to Monomer B is from 3:1 to 5:1, the molar ratio of monomer B to monomer C is greater than about 1, the copolymer has a weight average molecular weight (Mw) from about 20,000 g/mol to about 500,000 g/mol, and the copolymer and the non-ionic surfactant are present in a weight ratio of from about 0.03 to about 0.5, wherein the pH is from about 10.0 to about 11.

2. The hard surface cleaning composition according to claim 1, wherein the weight ratio of monomer B to monomer C is greater than about 1.

3. The hard surface cleaning composition according to claim 1 wherein monomer B is a salt of 3-methyl-1-vinylimidazolium.

4. The hard surface cleaning composition according to claim 1 wherein monomer A is methylpolyethylene glycol (meth)acrylate.

5. The hard surface cleaning composition according to claim 1 wherein monomer A is methylpolyethylene glycol (meth)acrylate and wherein monomer B is a salt of 3-methyl-1-vinylimidazolium, and monomer D is N-vinylimidazole.

6. The hard surface cleaning composition according to claim 1 wherein the composition further comprises:

from about 0.05 wt % to about 6 wt % of the composition of amine oxide surfactant, and from about 0.05 wt % to about 5 wt % of an anionic surfactant.

7. The hard surface cleaning composition according to claim 6, wherein the composition comprises:

a) from about 0.05 to about 3 wt % of the copolymer;

b) from about 4.0 wt % to about 9.0 wt % of the non-ionic surfactant;

c) from about 0.1 wt % to about 4.5 wt % of the composition of amine oxide surfactant, and d) from about 1.5 wt % to about 3.5 wt % of an anionic surfactant.

8. A method of improving shine of treated hard surfaces, the method comprising the following steps:

a) diluting a liquid hard surface cleaning composition of claim 1; and b) applying the liquid hard surface cleaning composition to a hard surface.

9. The method according to claim 8, subsequently comprising the step of rinsing.

10. The method according to claim 8, wherein the liquid hard surface cleaning composition is sprayed onto the hard surface.

11. The method according to claim 8, wherein the method also reduces the drying time of treated hard surfaces.

* * * * *